United States Patent [19]

Schaper et al.

[11] Patent Number: 4,804,419

[45] Date of Patent: Feb. 14, 1989

[54] CONTINUOUSLY OPERABLE SUGAR CENTRIFUGE

[75] Inventors: Helmut Schaper, Braunschweig; Heinrich Kurland, Erkerode-Lucklum, both of Fed. Rep. of Germany

[73] Assignee: Braunschweigische Maschinenbauanstalt AG, Braunschweig, Fed. Rep. of Germany

[21] Appl. No.: 105,394

[22] Filed: Oct. 5, 1987

[30] Foreign Application Priority Data

Oct. 4, 1986 [DE] Fed. Rep. of Germany ..... 3633890

[51] Int. Cl.[4] ..... C13F 1/06; C13F 1/10

[52] U.S. Cl. ..... 127/19; 127/2; 127/9; 210/369; 210/374; 210/377

[58] Field of Search ..... 127/19, 9, 2; 210/369, 210/374, 377

[56] References Cited

U.S. PATENT DOCUMENTS

| | | | |
|---|---|---|---|
| 3,238,063 | 3/1966 | Steele | 210/369 |
| 3,956,135 | 5/1976 | Mercier | 210/377 |
| 4,205,999 | 6/1980 | Zeichner et al. | 127/19 |

FOREIGN PATENT DOCUMENTS

| | | |
|---|---|---|
| 2025828 | 12/1971 | Fed. Rep. of Germany . |
| 3129392 | 3/1983 | Fed. Rep. of Germany . |

*Primary Examiner*—Curtis R. Davis
*Assistant Examiner*—Chung K. Pak
*Attorney, Agent, or Firm*—W. G. Fasse; D. H. Kane, Jr.

[57] ABSTRACT

A continuously operable sugar centrifugal is equipped with an upwardly opening conical centrifugal drum surrounded by a sugar collecting housing (3). The upper edge of the drum (1) is equipped with a sugar discharge flange which faces a rotatably mounted ring carrying a plurality of sugar crystal deflecting, spring elastically yielding, sheet metal members which may be mounted in a fixed position or in an adjustable position to the rotatable ring. In the embodiment with the adjustable sheet metal members, their angular position relative to the flight direction of the sugar crystals may be selected in accordance with particular requirements. The sheet metal members are so located that they function as sugar intercepting and deflecting elements. A ring conduit for applying a mashing liquid to the sheet metal members is arranged in a stationary position in parallel to the rotatable ring and axially spaced from the ring. The conduit is equipped with uniformly spaced exit openings for the discharge of mashing liquid onto the sheet metal members. A guide skirt or ring member may be so arranged as to guide the mashing liquid onto the sheet metal members, or so as to guide the liquid onto the sheet metal members and the sugar crystals into the collecting chamber.

21 Claims, 3 Drawing Sheets

CONTINUOUSLY OPERABLE SUGAR CENTRIFUGE

FIELD OF THE INVENTION

The invention relates to a continuously operable sugar centrifugal having a conical centrifugal drum opening upwardly in a sugar collecting housing.

DESCRIPTION OF THE PRIOR ART

German Pat. No. (DE-PS) 3,129,392 discloses a sugar centrifuge of the above type in which the wide, upper end of the centrifugal drum is equipped with a sugar discharge flange surrounded by sugar collecting elements. These sugar collecting elements are constructed as plane, thin, spring elastically yielding sheet metal members arranged at a certain angle of attack relative to the flight direction of the sugar crystals. These sheet metal members are secured to a rotatable ring that may be positively driven. Further, the angle of attack may be adjustable.

In the sugar centrifuge according to German Pat. No. (DE-PS) 3,129,392 the impingement of the sugar crystals on the spring elastically yielding sheet metal members achieves a gentle braking action or a change in the flight direction of the sugar crystals. These features are intended to reduce crystal breakage or damage to the crystals or to even avoid these damages to such an extent that the produced sugar at least meets the minimum requirements for so-called quality sugar.

Another conventional continuously operable sugar centrifugal as disclosed in German Pat. No. (DE-PS) 2,025,828 does not permit a gentle treatment of the sugar crystals prior and/or during the mashing because the sugar crystals are centrifuged on stationary walls, whereby the sugar crystals are exposed to substantial stress or loads. Besides, conventional centrifugals of this type are not suitable to be used selectively, either for producing high quality crystals or for the mashing of centrifuged crystals.

OBJECTS OF THE INVENTION

In view of the foregoing it is the aim of the invention to achieve the following objects singly or in combination:

to improve a sugar centrifugal of the above type to such an extent that it can be operated selectively either for producing crystalline sugar of a desired quality, or to operate it as a mashing centrifugal;

to assure an advantageous mixing of the sugar crystals with the supplied medium such as a mashing liquid;

to assure a gentle treatment of the sugar crystals even during mashing; and to provide for an optimally efficient introduction of the mashing liquid into the centrifuge.

SUMMARY OF THE INVENTION

The above objects are achieved in a continuously operable sugar centrifugal according to the invention by the following features. A stationary ring conduit is arranged at an axial spacing and in parallel to the positively drivable ring. The ring conduit is provided with discharge openings which are preferably uniformly distributed around the ring conduit for the continuous discharge of mashing liquid that is supplied into the ring conduit for the mashing of the sugar crystals which impinge on the above mentioned sheet metal members and/or of the sugar crystals which, after deflection by the sheet metal members, impinge on a guide wall arranged with a spacing from the sheet metal members.

The features of the invention utilize the gentle treatment of the sugar crystals for an especially advantageous intermixing or mashing of the crystals with the supplied medium such as a mashing liquid. Experience has shown that it is advantageous if the number of crystal splinters in the magma produced by the mashing, is as small as possible, especially if the magma is further used as a crystal base or if the magma is further processed in a second centrifuging operation which is frequently practiced in the sugar industry for achieving uniform sugar crystals.

In a centrifuge constructed as taught herein, the impingement energy of the sugar crystals is reduced by the spring elastic yielding of the sheet metal members, whereby damages to the crystals can be substantially prevented by the adjustment of the r.p.m. of the drivable rings holding the sheet metal members and by the adjustment of the angle of attack. These features assure a soft braking action or deflection of the sugar crystals to substantially avoid said damages. By supplying the mashing liquid onto the sheet metal members and/or onto a guide wall or skirt spaced from the sheet metal members during the impingement of the crystals on these members or guide wall or skirt, the impingement energy is further reduced because the sugar crystals enter into a mashing liquid film maintained on the sheet metal members and/or on the guide wall or skirt. An added benefit of this function is an intensive intermixing of the crystals with the mashing liquid so that very advantageous mashing conditions are provided.

In one embodiment of the invention the sheet metal members are surrounded by a guide wall or skirt. By selecting the rotational speed of the ring carrying the sheet metal members, and/or by respectively selecting the angle of attack of the sheet metal members, it is assured that only a small proportion of the impingement energy of the sugar crystals is taken up by the sheet metal members. Further, these features assure that the sugar crystals are mostly deflected by the sheet metal members and the main proportion of the impingement energy is taken up by the guide skirt over which the mashing liquid flows continuously. Thus, the mashing liquid is enabled to take up an additional proportion of the energy resulting from the crystals impinging on the guide wall or skirt.

In centrifugals in which the sheet metal members are not surrounded by the guide wall, it is especially suitable if the ring conduit is arranged below the sheet metal members, whereby the mashing liquid exit openings are constructed as discharge nozzles directed toward the sheet metal members. This feature assures a direct spraying of the mashing liquid onto the sheet metal members, whereby the quantity of the liquid can be suitably dosed so that a continuous overflow of the mashing liquid over the sheet metal members is assured.

In another embodiment of the invention the overflow of the sheet metal members by the mashing liquid is assured in that the ring conduit is arranged above the rotating ring. A conical guide wall or skirt which narrows upwardly, surrounds the holes in the driven ring. These holes are preferably located to face the respective sheet metal members. The conical guide wall or skirt extends upwardly from the driven ring. The holes in the stationary ring conduit on the other hand, are facing substantially toward the conical guide wall or skirt. In this embodiment the mashing liquid is guided by the conical guide wall or skirt through the holes in the driven ring onto the individual sheet metal members, whereby the mashing liquid is used in an especially efficient manner for the mashing of these sugar crystals.

In sugar centrifugals of the type using a guide wall or skirt surrounding the sheet metal members, the ring conduit is suitably arranged above the driven ring. A conical guide wall or skirt having a diameter that increases toward the drum bottom, surrounds the driven ring as a guide wall or skirt with a radial spacing. Thus, this conical guide wall or skirt also surrounds the sheet metal members carried by the driven ring. The holes for the mashing liquid in the ring conduit are directed onto the conical guide wall or skirt. This construction makes sure that a liquid film is formed at least in the lower zone of the conical guide wall or skirt so that the sugar crystals which are deflected by the sheet metal members and thus come onto the guide wall or skirt, are immersed in this liquid film on the guide wall or skirt. This immersion provides a braking action and the crystals are fully enveloped by the liquid without any danger of a destruction of the sugar crystals when they impinge on the conical guide wall or skirt.

The supply of the mashing liquid to the conical guide wall or skirt can be accomplished in several ways. This applies when the guide wall or skirt is arranged above the rotatable ring and also when the conical guide skirt forms a guide wall surrounding the sheet metal members. Thus, the liquid supply can be accomplished by nozzles in the ring conduit or even more efficiently in that the holes in the ring conduit are surrounded by tubular sections which have a cross-section adapted to the hole diameter in the ring conduit and which face toward the conical guide wall or skirt. The tubular sections make sure that the liquid is lead close to the conical guide wall or skirt so that as little as possible of the liquid is dissipated in a spray, whereby it would become useless as far as the mashing is concerned. The invention avoids this.

BRIEF DESCRIPTION OF THE DRAWINGS

In order that the invention may be clearly understood, it will now be described, by way of example, with reference to the accompanying drawings, wherein.

Figure 1:
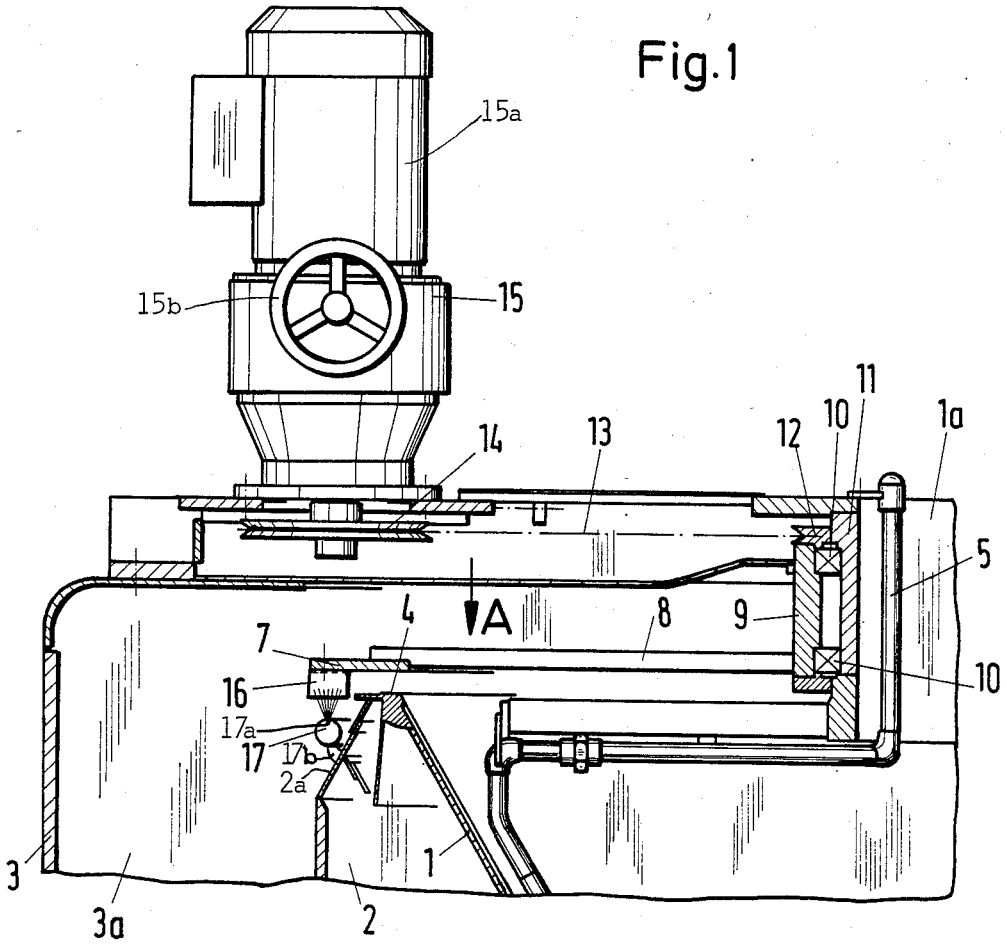
FIG. 1 is a partial axial section through a zone of the large diameter end of the centrifugal drum of a sugar centrifugal according to the invention.

DETAILED DESCRIPTION OF PREFERRED EXAMPLE EMBODIMENTS AND OF THE BEST MODE OF THE INVENTION

In each of the figures, the conical centrifugal drum 1 widens upwardly and the centrifugal drum 1 is surrounded by a liquid collection space 2 which in turn is enclosed by a sugar collecting housing 3. The centrifugal drum 1 is mounted for rotation about a central axis. The drum is driven by a motor and respective drive transmission means. Both, the mounting and the drive means are not shown since they are conventional. In any event, the drum is driven in such a way that the massecuite introduced into the narrow end portion of the drum is separated along the screens of the drum 1 into the sugar and a liquid run-off phase. The run-off is collected in the chamber 2 while the sugar crystals travel at very high speed over the discharge flange 4 which is provided at the large diameter end of the drum 1. The sugar crystals travel tangentially along the discharge flange 4 toward the collecting chamber **3*a* in the housing 3**.

A covering liquid is applied through a conduit or pipe 5 onto the massecuite travelling upwardly on the inner screen surface of the drum 1. The conduit or pipe 5 enters centrally through an opening **1*a* in the cover of the centrifugal. Further, the conduit or pipe 5 serves simultaneously for introducing massecuite into the bottom of the drum. This is conventional and hence not shown in detail. A flexible collar 2*a* separates chambers 2 and 3*a***.

Figure 2:
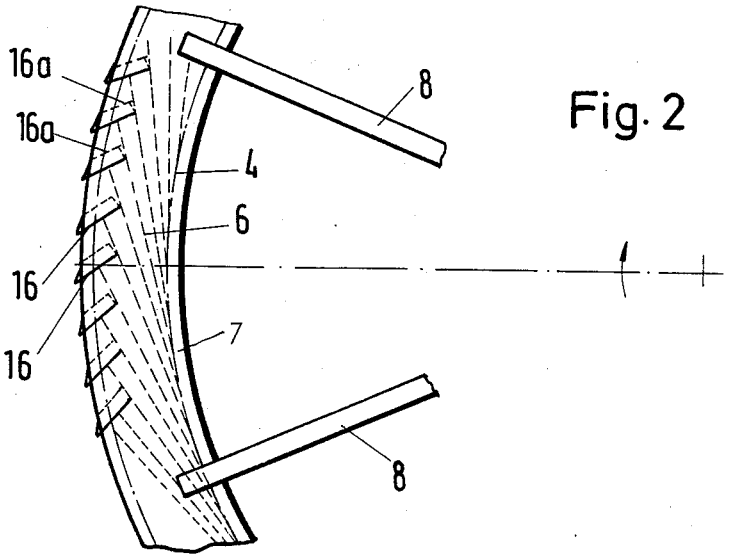
FIG. 2 is a partial top plan view in the direction of the arrow A of the centrifuge according to FIG. 1.

The dashed lines 6 shown on the flange 4 in FIG. 2 indicate the travel direction of the sugar crystals from the inner surface of the drum outwardly into the collecting chamber 3.

A ring 7 is rotatably mounted in the centrifugal above the upper wide diameter end of the drum 1. The ring 7 can be positively driven as will be described below. The driven ring 7 has a slight axial spacing from the discharge flange 4 and extends substantially in parallel to the flange 4. The ring 7 is mounted to the radially outer ends of arms 8 forming spokes which in turn are connected with their radially inner end to a hub 9 mounted in bearings 10 carried by a stationary central sleeve surrounding the central opening **1*a*. The hub 9 carries at its upper end, a V-belt pulley 12 rigidly secured to the hub 9 and cooperating with a V-belt 13 running around a drive pulley 14 driven by a motor 15*a* through gear means 15 provided with speed adjustment means 15*b* as is conventional. The motor 15** is mounted in a stationary position on the centrifugal housing, for example on its cover.

Thin, spring elastically yielding sheet metal members 16 are secured to the underside of the drivable ring 7. These sheet metal members 16 are so mounted and located that they reach into the flight path of the sugar crystals flying off the flange 4. Thus, the sheet metal members 16 can intercept the sugar crystals. The sheet metal members 16 are preferably uniformly spaced from one another along the downwardly facing outer edge portion of the ring 7. These sheet metal members 16 are sufficiently flexible so that their downwardly reaching free edges can deflect in the travel direction of the sugar crystals impinging on these sheet metal members. The deflected lower free longitudinal edges of the sheet members 16 are shown by the dashed lines **16*a* as seen in FIG. 2**.

Referring further to FIG. 2, the thin elastically yielding sheet metal members 16 are so arranged that they extend approximately at a right angle to the flight direction of the sugar crystals. Conventional mounting means, not shown, may be used for mounting the sheet metal member 16 to the ring 7. Each mounting means may provide for adjusting the angular position of the respective sheet metal member 16 relative to the flight direction of the sugar crystals.

Since the rotational speed of the drive means 15, **15*a* is adjustable, it is possible to control the r.p.m. of the ring 7 and thus of the sheet metal members 16 carried by the ring so that the optimal r.p.m. is selected with regard to a gentle treatment of the sugar crystals and so as to avoid damage or destruction of the sugar crystals when they are deflected by the members 16. Additionally, the spring elastic reaction of the members 16 to an impingement by the sugar crystals makes sure that the braking action is gently applied to the sugar crystals, yet substantially reduces the speed of the sugar crystals before they enter into the sugar collecting chamber 3***a* in the housing 3.

A ring conduit or pipe 17 is mounted below the ring 7 and below the sheet metal members 16 in the embodiment of FIGS. 1 and 2. The ring conduit 17 is mounted at 17*b* in a stationary position. The ring conduit 17 has a plurality of upwardly directed nozzle openings 17*a* for supplying or directing mashing liquid onto the sheet metal members 16. The supply of mashing liquid into the ring conduit or pipe 17 is accomplished by conventional means not shown. A small excess pressure is maintained in the ring conduits 17 so that a mashing liquid film is formed on the sheet metal members 16. The sugar crystals thus impinge on the mashing liquid film after passing the discharge flange 4. The liquid film has the advantage that it gently dampens the movement of the sugar crystals while simultaneously causing the mashing of the sugar crystals with the mashing liquid. Another advantage of the liquid film on the members 16 is the fact that the film prevents the sugar crystals from sticking to the sheet metal member 16. Due to the elastically yielding movement of the sheet metal member 16 and due to the rotation of the carrier ring 7, it is assured that the mashing liquid and the crystals slide off the sheet metal members 16, whereby the sugar crystals are transferred into the sugar collecting chamber 3*a* at a speed which is substantially smaller than the circumferential speed of the flange 4 of the drum 1.

Figure 3:
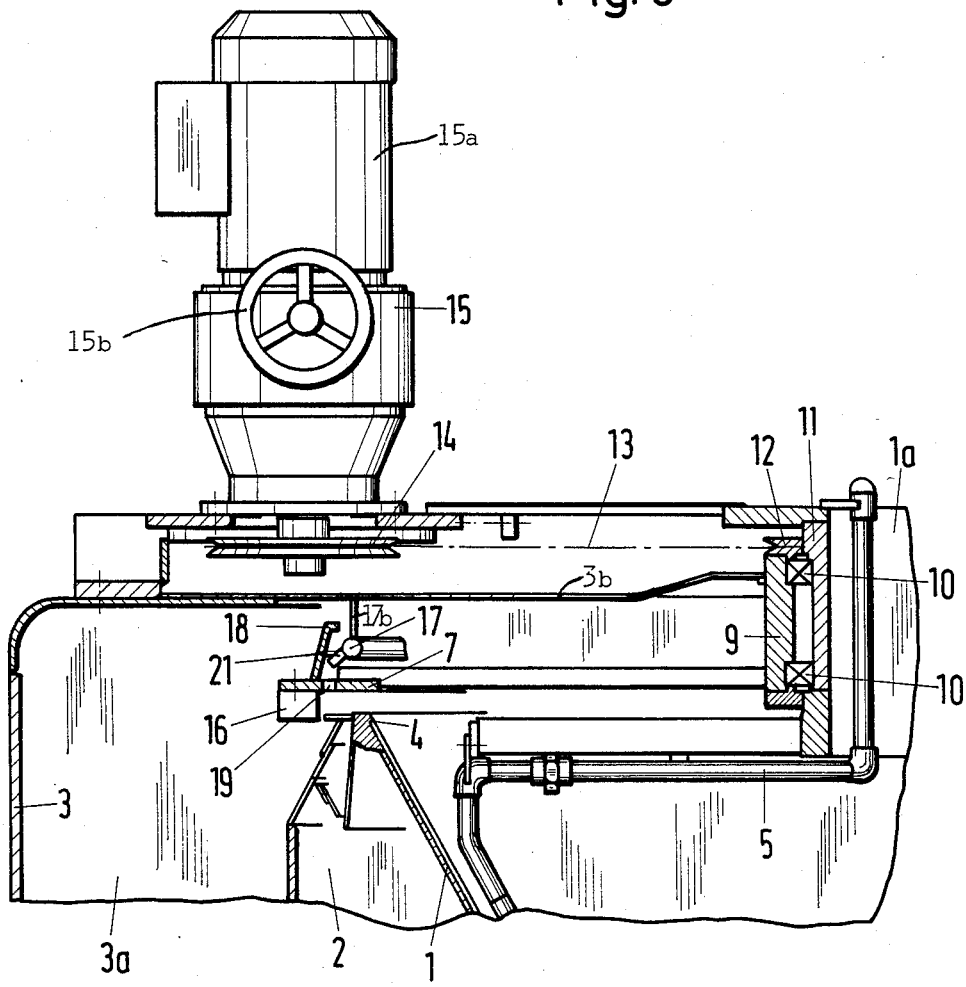
FIG. 3 is a partial section corresponding to that of FIG. 1 through a modified embodiment of a sugar centrifugal according to the invention.

Referring to FIG. 3, the ring conduit 17 in this embodiment is arranged above the ring 7, rather than below the ring 7. The ring conduit 17 of FIG. 3 is mounted by mounting brackets 17*b* to a cover 3*b* of the housing 3. The rotatable ring 7 is equipped with a guide wall or guide skirt 18 which has an upwardly tapering conical shape with a radially inwardly extending flange portion for enclosing the stationary conduit 17. The guide wall or skirt 18 is rigidly secured to the ring 7 in a fluid tight manner and rotates with the ring 7. Holes 19 pass through the ring 7 radially inwardly of and above each sheet metal member 16 so that mashing liquid coming through outlet nozzles 21 of the stationary ring 17, passes through these holes 19 and radially outwardly onto the sheet metal member 16. Thus, the mashing liquid flows onto the sheet metal members 16 to form the above mentioned film on the surface of these members 16. The above described effects are the same since here again the sugar crystals impinge upon the film on the surface of the member 16. In all other respects, the embodiment of FIG. 3 is the same as that of FIGS. 1 and 2.

Figure 4:
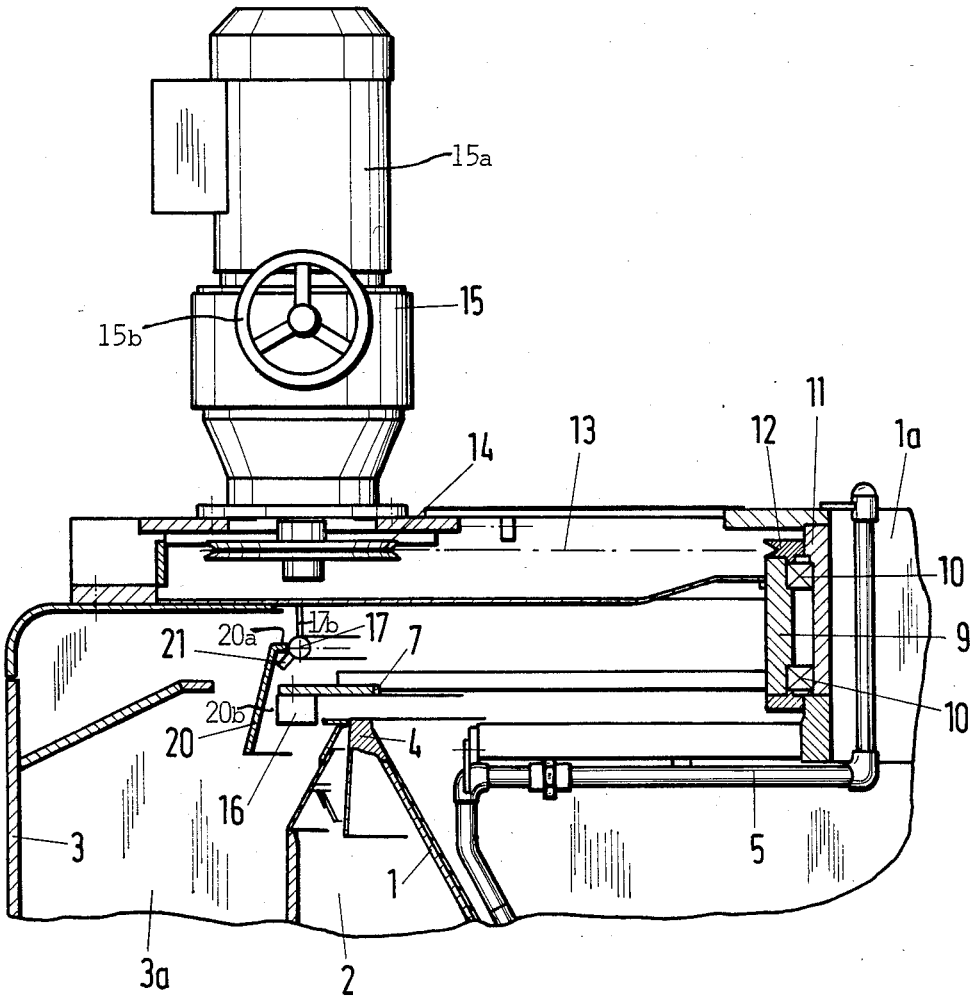
FIG. 4 shows a further partial section similar to those of FIGS. 1 and 2, through a third embodiment of a centrifuge according to the invention.

Referring to FIG. 4, the ring conduit 17 is again arranged above the rotating ring 7. The mashing liquid coming out of the nozzles 21 of the conduit 17 is guided by a guide wall or skirt 20 which has a downwardly opening conical shape with an upper flange 20*a*. The guide skirt 20 may be stationary, in which case the guide skirt 20 is connected to the ring conduit 17 so that the guide skirt 20 and the conduit 17 are both held in place by the brackets 17*b*. However, in the more advantageous alternative, the guide skirt 20 may be secured to the rotating ring 7 with a radial spacing 20*b* between the ring 7 and the guide skirt 20. Radially extending spacers, not shown, may mount the guide skirt 20 to the ring 7, whereby the flange 20*a* and guide skirt 20 rotate relative to the stationary conduit 17. In both instances, the effects would be the same in that the stationary or rotating guide skirt 20 is metal members 16 carried by the ring 7 are again covered with a mashing liquid film coming through the nozzles 21 and radial spacing 20*b*. The sheet metal members 16 are so arranged that a braking action is applied to the sugar crystals, whereby the sugar crystals are simultaneously deflected toward the guide skirt 20. The deflection is partially accomplished by the yielding movement of the lower free edge of each of the sheet metal members 16 as indicated at 16*a* in FIG. 2.

The liquid film formed on the sheet metal members 16 or on the guide skirt 20 has the above mentioned damping effect in all embodiments, whereby an efficient mashing of the sugar crystals with the mashing liquid is assured. Additionally, the sugar crystals are guided by the guide skirt 20 at a substantially lower speed into the collecting chamber 3*a* than the speed at which the sugar crystals pass over the discharge flange 4. The discharge speed of the sugar crystals from the lower edge of the guide skirt 20 may be effectively controlled in the embodiment in which the guide skirt 20 rotates with the ring 7 since the speed of the ring 7 and thus of the guide skirt 20 is easily controlled by controlling the r.p.m. of the drive means. The flowing motion of the mashing liquid and of the sugar crystals along the lower portion of the inner surface of the guide skirt 20 enhances the intensive mixing and thus mashing of the sugar crystals with the mashing liquid.

The nozzles 21 in FIGS. 3 and 4 are so directed that the mashing liquid is guided as directly as possible onto the guide wall or guide skirt 18 in FIG. 3 and onto the skirt 20 in FIG. 4. Further, the nozzles 21 in the form of tubular sections surround the openings in the ring conduit 17 so that spraying action, or rather a diffusion of the mashing liquid, is substantially avoided. The pressure in the ring conduit 17 should be rather small, for example, within the range of 1.5–3 bar. These nozzles 21 avoid a vaporization or scattering of the mashing liquid while still assuring a uniform distribution of the mash liquid to form the above mentioned film on the surfaces of the sheet metal members 16 and/or on the skirt 20.

Although the invention has been described with reference to specific example embodiments, it will be appreciated, that it is intended to cover all modifications and equivalents within the scope of the appended claims.

What we claim is:

1. A continuously operable sugar centrifuge, comprising an upwardly opening centrifugal drum having a sugar discharge flange forming an upper edge, housing means surrounding said centrifugal drum and forming a sugar collecting chamber, a plurality of flexible sugar deflecting members, rotatable ring means for carrying said flexible sugar deflecting members, mounting means for rotatably mounting said rotatable ring means in said housing means in such a position that said flexible sugar deflecting members are located to intercept sugar crystals moving over said sugar discharge flange, drive means operatively connected to said ring means for rotating said ring means, a mashing liquid supply ring conduit having a plurality of liquid discharge openings, means for mounting said mashing liquid supply ring conduit in a stationary position relative to said flexible sugar deflecting members so that mashing liquid discharged from said liquid discharge openings of said mashing liquid supply ring conduit comes into contact with said flexible sugar deflecting members for forming a mashing liquid film on said flexible sugar deflecting members, whereby the movement of said sugar crystals that have passed over said sugar discharge flange and which impinge on said mashing liquid film is gently dampened by said mashing liquid film which simultaneously causes a mashing of said sugar crystals, and wherein said means for mounting said mashing liquid supply ring conduit mount said mashing liquid supply ring conduit below said rotatable ring means, said discharge openings of said mashing liquid supply ring conduit being directed upwardly toward said flexible sugar deflecting members for directly impinging on said flexible surgar deflecting members.

2. The sugar centrifuge of claim 1, wherein said discharge openings of said mashing liquid supply ring conduit comprise nozzle members directed toward said flexible sugar deflecting members.

3. The sugar centrifuge of claim 1, further comprising a tubular member (21) for each of said liquid discharge openings, said tubular member having a diameter surrounding the respective opening, said tubular members being secured to said mashing liquid supply ring conduit in a stationary position at an angle for effectively directing said mashing liquid.

4. The centrifuge of claim 1, wherein said flexible sugar deflecting members are thin plane sheet metal members secured to said rotatable ring means at uniform spacings between neighboring sheet metal members.

5. The centrifuge of claim 4, wherein said liquid discharge openings are uniformly spaced from one another.

6. The centrifuge of claim 1, wherein said drive means comprise control means for adjusting the revolutions per minute of said rotatable ring means carrying said flexible sugar deflecting members.

7. A continuously operable sugar centrifuge, comprising an upwardly opening centrifugal drum having a sugar discharge flange forming an upper edge, housing means surrounding said centrifugal drum and forming a sugar collecting chamber, a plurality of flexible sugar deflecting members, rotatable ring means for carrying said flexible sugar deflecting members, mounting means for rotatably mounting said rotatable ring means in said housing means in such a position that said flexible sugar deflecting members are located to intercept sugar crystals moving over said sugar discharge flange, drive means operatively connected to said ring means for rotating said ring means, a guide skirt for guiding mashing liquid, a mashing liquid supply ring conduit having a plurality of liquid discharge openings, means for mounting said mashing liquid supply ring conduit in a stationary position relative to said flexible sugar deflecting members above said rotatable ring means so that mashing liquid discharged from said liquid discharge openings of said mashing liquid supply ring conduit comes into contact with said guide skirt and with said flexible sugar deflecting members for forming a mashing liquid film on said flexible sugar deflecting members, whereby the movement of said sugar crystals that have passed over said sugar discharge flange and which impinge on said mashing liquid film is gently dampened by said mashing liquid film which simultaneously causes a mashing of said sugar crystals on said flexible sugar deflecting members.

8. The sugar centrifuge of claim 7, wherein said rotatable ring means comprise holes (19) for passing mashing liquid through said rotatable ring means onto said flexible sugar deflecting members.

9. The sugar centrifuge of claim 8, wherein said guide skirt is secured to said rotatable ring means for rotation with said rotatable ring means, said guide skirt being further secured in a position radially outwardly of said holes (19) to guide said mashing liquid through said holes in said rotatable ring means.

10. The sugar centrifuge of claim 8, wherein said guide skirt is secured to said mashing liquid supply ring conduit in a stationary position radially outwardly of said holes (19) for guiding said mashing liquid from said openings through said holes in said rotatable ring means.

11. The sugar centrifuge of claim 7, further comprising a tubular member (21) for each of said liquid discharge openings, said tubular member having a diameter surrounding the respective opening, said tubular members being secured to said mashing liquid supply ring conduit in a stationary position at an angle for effectively directing said mashing liquid.

12. The centrifuge of claim 7, wherein said flexible sugar deflecting members are thin plane sheet metal members secured to said rotatable ring means at uniform spacings between neighboring sheet metal members.

13. The centrifuge of claim 2, wherein said liquid discharge openings are uniformly spaced from one another.

14. The centrifuge of claim 7, wherein said drive means comprise control means for adjusting the revolutions per minute of said rotatable ring means carrying said flexible sugar deflecting members.

15. A continuously operable sugar centrifuge, comprising an upwardly opening centrifugal drum having a sugar discharge flange forming an upper edge, housing means surrounding said centrifugal drum and forming a sugar collecting chamber, a plurality of flexible sugar deflecting members, rotatable ring means for carrying said flexible sugar deflecting members, mounting means for rotatably mounting said rotatable ring means in said housing means in such a position that said flexible sugar deflecting members are located to intercept sugar crystals moving over said sugar discharge flange, drive means operatively connected to said rotatable ring means for rotating said rotatable ring means, a guide skirt having a downwardly opening conical shape mounted at a spacing radially outwardly from said rotatable ring means, a mashing liquid supply ring conduit having a plurality of liquid discharge openings, means for mounting said mashing liquid supply ring conduit in a stationary position relative to said guide skirt so that mashing liquid discharged from said liquid discharge openings of said mashing liquid supply ring conduit comes into contact with said guide skirt for forming a mashing liquid film on said guide skirt, whereby the movement of said sugar crystals that have passed over said sugar discharge flange and which impinge on said mashing liquid film on said guide skirt is gently dampened by said mashing liquid film which simultaneously causes a mashing of said sugar crystals while said guide skirt guides said sugar crystals into said sugar collecting chamber.

16. The sugar centrifuge of claim 15, wherein said guide skrit is secured to said rotatable ring means.

17. The sugar centrifuge of claim 15, wherein said guide skirt is a secured to said mashing liquid supply ring conduit in a stationary position.

18. The sugar centrifuge of claim 15, further comprising a tubular member (21) for each of said liquid discharge openings, said tubular member having a diameter surrounding the respective opening, said tubular members being secured to said mashing liquid supply ring conduit in a stationary position at an angle for effectively directing said mashing liquid toward said guide skirt.

19. The centrifuge of claim 15, wherein said flexible sugar deflecting members are thin plane sheet metal members secured to said rotatable ring means at uniform spacings between neighboring sheet metal members.

20. The centrifuge of claim 19, wherein said liquid discharge openings are uniformly spaced from one another.

21. The centrifuge of claim 15, wherein said drive means comprise control means for adjusting the revolutions per minute of said rotatable ring means carrying said flexible sugar deflecting members.

* * * * *